US008354985B2

(12) United States Patent
Woo

(10) Patent No.: US 8,354,985 B2
(45) Date of Patent: Jan. 15, 2013

(54) DRIVING APPARATUS, LIQUID CRYSTAL DISPLAY HAVING THE SAME AND DRIVING METHOD THEREOF

(75) Inventor: Doo-Hyung Woo, Anyang-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 689 days.

(21) Appl. No.: 12/277,788

(22) Filed: Nov. 25, 2008

(65) Prior Publication Data

US 2009/0302903 A1 Dec. 10, 2009

(30) Foreign Application Priority Data

Jun. 9, 2008 (KR) ..... 10-2008-0053765

(51) Int. Cl.
*G09G 3/34* (2006.01)

(52) U.S. Cl. ..... 345/87; 345/211

(58) Field of Classification Search ..... 345/87, 345/102, 95, 211, 212, 210; 327/143
See application file for complete search history.

(56) References Cited

U.S. PATENT DOCUMENTS

| | | | | |
|---|---|---|---|---|
| 5,214,316 | A * | 5/1993 | Nagai | 327/143 |
| 6,363,146 | B1 * | 3/2002 | Aranovich et al. | 379/422 |
| 6,901,525 | B2 * | 5/2005 | Baker et al. | 713/340 |
| 2002/0095544 | A1 * | 7/2002 | Lee | 711/5 |
| 2007/0132030 | A1 * | 6/2007 | Chen | 257/355 |

* cited by examiner

*Primary Examiner* — Chanh Nguyen
*Assistant Examiner* — Tsegaye Seyoum
(74) *Attorney, Agent, or Firm* — Frank Chau & Associates, LLC

(57) ABSTRACT

A driving apparatus resets driving circuits provided therein after an internal supply voltage reaches a sufficient voltage level. The driving apparatus includes a reset signal generator that resets the driving circuits when the internal supply voltage exceeds the external supply voltage in a rising period of the internal supply voltage. Accordingly, the driving circuits may be prevented from being reset before the internal supply voltage reaches the sufficient voltage level, thereby preventing an abnormal operation of the driving circuits.

11 Claims, 5 Drawing Sheets

DRIVING APPARATUS, LIQUID CRYSTAL DISPLAY HAVING THE SAME AND DRIVING METHOD THEREOF

CROSS-REFERENCE TO RELATED APPLICATION

This application relies for priority upon Korean Patent Application No. 2008-53765 filed on Jun. 9, 2008, the contents of which are herein incorporated by reference in their entirety.

BACKGROUND

1. Technical Field

The present disclosure relates to a driving apparatus and a liquid crystal display (LCD) having the same. More particularly, the present disclosure relates to a driving apparatus, which controls an output time of a reset signal resetting various circuits provided therein, and an LCD having the driving apparatus.

2. Discussion of Related Art

Recently, an LCD has been extensively applied to a mobile product having an image display function due to its small size, light weight, and low power consumption. The mobile product typically employs a power saving mode to reduce power consumption.

More specifically, the LCD is frequently powered on and off, and when the LCD is powered on, logic states of driving circuits in the LCD are reset. Thus, the LCD includes a power-on reset circuit generating a reset signal to reset the driving circuits when the LCD is powered on. The reset signal must be applied to the driving circuits after the supply voltage for the driving circuits reaches a stable, sufficient voltage level. If the reset signal is applied to the driving circuits before the supply voltage reaches a sufficient voltage level, the driving circuits perform an unstable operation. The unstable operation means that logic determination of the circuit for a logic "H" or "L" is impossible. Thus, a method allowing the driving circuits to be reset by the reset signal after the supply voltage reaches the sufficient voltage level is required.

SUMMARY

Therefore, an exemplary embodiment of the present invention provides a driving apparatus that outputs a reset signal to a corresponding logic circuit after the supply voltage reaches a stable voltage level.

An exemplary embodiment of the present invention provides a liquid crystal display having the driving apparatus.

An exemplary embodiment of the present invention provides a driving method of the driving apparatus.

In an exemplary embodiment of the present invention, a driving apparatus includes a voltage generator and a reset signal generator. The voltage generator receives an external supply voltage and boosts the external supply voltage to output an internal supply voltage. The reset signal generator receives the external supply voltage and the internal supply voltage and outputs a reset signal, which resets the driving unit, when the internal supply voltage exceeds the external supply voltage in a rising period of the internal supply voltage.

In an exemplary embodiment of the present invention, a liquid crystal display includes a voltage generator, a reset signal generator, a driving unit, and a liquid crystal display panel. The voltage generator receives an external supply voltage and boosts the external supply voltage to output an internal supply voltage. The reset signal generator receives the external supply voltage and the internal supply voltage and outputs a reset signal when the internal supply voltage exceeds the external supply voltage in a rising period of the internal supply voltage. The driving unit generates a driving signal in response to the internal supply voltage and resets the driving signal in response to the reset signal. The liquid crystal display panel displays an image in response to the driving signal. The liquid crystal display includes a display area displaying an image and a peripheral area surrounding the display area defined thereon.

In an exemplary embodiment of the present invention, a driving method of a driving apparatus is provided as follows. An external supply voltage is received from an external device and is converted into an internal supply voltage. Then, the external supply voltage is compared with the internal supply voltage, and the driving apparatus is reset when the internal supply voltage exceeds the external supply voltage in a rising period of the internal supply voltage.

According to the above-described exemplary embodiments, the driving circuits provided in the driving apparatus are reset after the internal supply voltage reaches a sufficient voltage level. Thus, the driving circuits are prevented from being reset before the internal supply voltage reaches the sufficient voltage level, so that an abnormal operation of the driving circuits may be prevented.

BRIEF DESCRIPTION OF THE DRAWINGS

Exemplary embodiments of the present invention will be understood in more detail from the following descriptions taken in conjunction with the accompanying drawings, wherein.

DETAILED DESCRIPTION OF EXEMPLARY EMBODIMENTS

Hereinafter, exemplary embodiments of the present invention will be explained in more detail with reference to the accompanying drawings.

Figure 1:
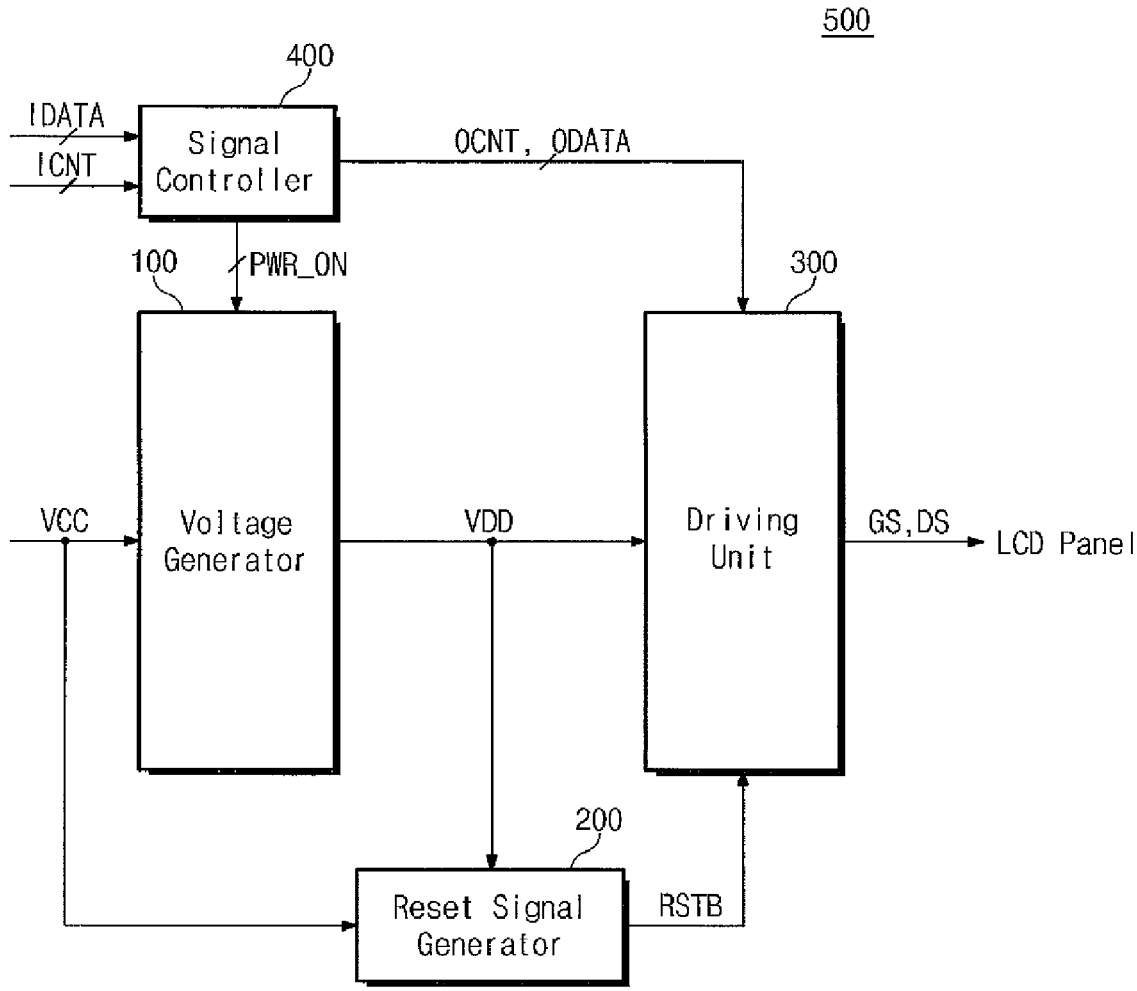
FIG. 1 is a block diagram illustrating an exemplary embodiment of a driving apparatus according to the present invention.

FIG. 1 is a block diagram illustrating an exemplary embodiment of a driving apparatus according to the present invention.

Referring to FIG. 1, a driving apparatus 500 includes a voltage generator 100, a reset signal generator 200, a driving unit 300, and a signal controller 400.

The voltage generator 100 boosts an external supply voltage VCC provided from an external voltage source (not shown) up to an internal supply voltage VDD in response to a power-on signal PWR_ON provided from the signal controller 400. The internal supply voltage VDD is applied to the driving unit 300 to drive the driving unit 300. IN order to stably drive the driving unit 300, the internal supply voltage VDD is applied to the driving unit 300. For example, a 3V DC supply voltage may be used as the external supply voltage VCC and a 5V DC supply voltage may be used as the internal supply voltage VDD. The internal supply voltage VDD has a rising period where the internal supply voltage VDD increases to 5V and a falling period where the internal supply voltage VDD decreases to 0V when the driving apparatus 500 is powered off. The internal supply voltage VDD maintains the 5V level during the remaining time period except for the rising and falling periods.

The reset signal generator 200 outputs a reset signal RSTB to reset the driving unit 300 when the internal supply voltage VDD exceeds the external supply voltage VCC. Because the reset signal RSTB generated from the reset signal generator 200 is applied to the driving unit 300 after the internal supply voltage VDD reaches the external supply voltage VCC, an abnormal reset operation of the driving unit 300 can be prevented.

The reset signal generator 200 will be described in detail hereinbelow with reference to FIGS. 2 and 3.

The driving unit 300 receives the internal supply voltage VDD from the voltage generator 100 as a driving voltage and outputs driving signals GS and DS in response to an output control signal OCNT and an output image data signal ODATA output from the signal controller 400. The driving signals GS and DS include a gate driving signal GS and a data driving signal DS. The driving signals GS and DS will be described hereinbelow in detail with reference to FIG. 5. The driving signals GS and DS output from the driving unit 300 are applied to an LCD panel (not shown in FIG. 1), so that the LCD panel displays a predetermined image in response to the driving signals GS and DS.

The signal controller 400 receives an input image data signal IDATA and an input control signal ICNT, which controls input timing of the input image data signal IDATA, from an external device, for example, a graphic controller (not shown). Then, the signal controller 400 converts the input image data signal IDATA and the input control signal ICNT into an output image data signal ODATA and an output control signal OCNT, respectively, and outputs the output image data signal ODATA and the output control signal OCNT to the driving unit 300.

Figure 2:
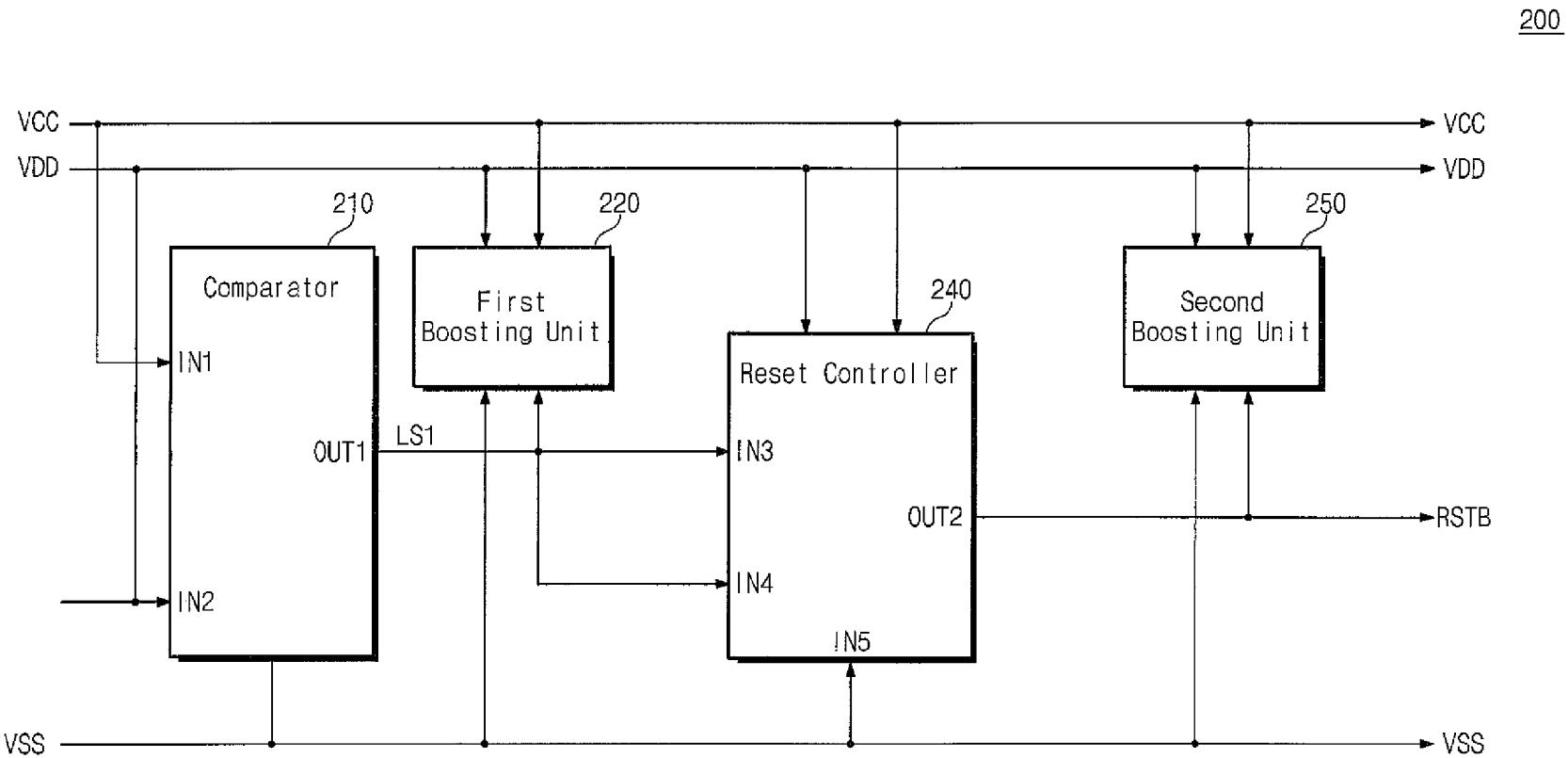
FIG. 2 is a block diagram illustrating the configuration of the reset signal generator shown in FIG. 1.

FIG. 2 is a block diagram illustrating the configuration of the reset signal generator 200 shown in FIG. 1.

Referring to FIG. 2, the reset signal generator 200 includes a comparator 210, a first boosting unit 220, a reset controller 240, and a second boosting unit 250.

The comparator 210 has first and second input terminals IN1 and IN2, respectively, and a first output terminal OUT1. The comparator 210 receives the external supply voltage VCC and the internal supply voltage VDD through the first and second input terminals IN1 and IN2, respectively. Then, the comparator 210 compares the external supply voltage VCC with the internal supply voltage VDD and outputs a first logic signal LS1 in either a low or high state according to the comparison result.

More specifically, if the internal supply voltage VDD is smaller than the external supply voltage VCC in the rising period of the internal supply voltage VDD, the comparator 210 outputs the first logic signal LS1 in a low state through the first output terminal OUT1. To the contrary, if the internal supply voltage VDD exceeds the external supply voltage VCC in the rising period of the internal supply voltage VDD, the comparator 210 outputs the first logic signal LS1 in a high state through the first output terminal OUT1.

The first boosting unit 220 receives the internal supply voltage VDD, the external supply voltage VCC, and a ground supply voltage VSS and boosts the potential of the first logic signal LS1 at the first output terminal OUT1 by using the internal supply voltage VDD, the external supply voltage VCC, and the ground supply voltage VSS. More specifically, when the first logic signal LS1 transits from a low state to a high state, the first boosting unit 220 boosts the voltage level of the first logic signal LS1 corresponding to the high state. Thus, the first boosting unit 220 transits the first logic signal LS1 from the low state to the high state at a high speed.

The reset controller 240 includes third and fourth input terminals IN3 and IN4 and a second output terminal OUT2. The reset controller 240 outputs the reset signal RSTB through the second output terminal OUT2 in response to the first logic signal LS1 in the high state applied through the third and fourth input terminals IN3 and IN4. The output reset signal RSTB is applied to the driving unit 300 shown in FIG. 1 to reset the driving unit 300. Although not shown in FIG. 2, the reset controller 240 may have another input terminal (IN5) receiving the ground supply voltage VSS.

The second boosting unit 250 receives the internal supply voltage VDD, the external supply voltage VCC and the ground supply voltage VSS to boost the potential of the reset signal RSTB at the second output terminal OUT2 by using the internal supply voltage VDD, the external supply voltage VCC and the ground supply voltage VSS. The second boosting unit 250 performs the same function as that of the first boosting unit 220. Thus, the second boosting unit 250 transits the reset signal RSTB from the low state to the high state at a high speed.

In the operation of the reset signal generator 200, the first logic signal LS1 provided from the comparator 210 is transited from the low state to the high state at the point in time at which the internal supply voltage VDD exceeds the external supply voltage VCC. Then, the reset controller 240 applies the reset signal RSTB to the driving unit 300 in response to the first logic signal LS1 in the high state, whereby the reset signal RSTB resets the driving unit 300. As a result, after the internal supply voltage VDD reaches a sufficient voltage level and then exceeds the external supply voltage VCC, the driving unit 300 is reset by the reset signal RSTB. Thus, an abnormal operation of the driving unit 300 during an initial operation of the driving unit 300, which is caused by the reset of the driving unit 300 before the internal supply voltage VDD reaches the sufficient voltage level, can be prevented.

Hereinafter, the reset signal generator 200 will be described in more detail.

Figure 3:
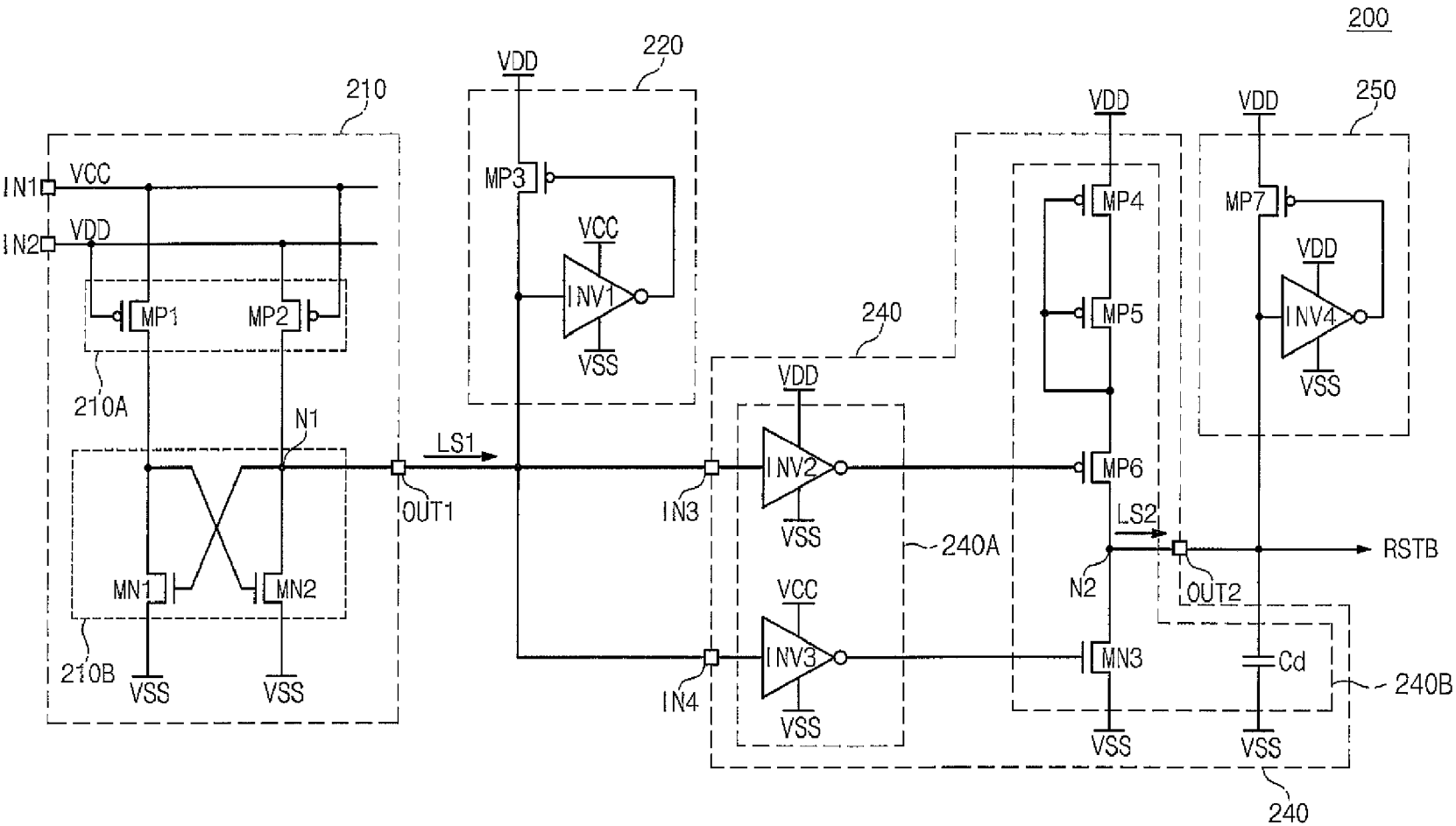
FIG. 3 is a circuit diagram illustrating the configuration of the reset signal generator shown in FIG. 2.

FIG. 3 is a circuit diagram illustrating the configuration of the reset signal generator 200 shown in block diagram form in FIG. 2.

Referring to FIG. 3, the comparator 210 includes an input unit 210A and an output unit 210B. In the rising period of the internal supply voltage VDD, if the internal supply voltage VDD is lower than the external supply voltage VCC, the input unit 210A outputs the external supply voltage VCC. If the internal supply voltage VDD is higher than the external supply voltage VCC, however, the input unit 210A outputs the internal supply voltage VDD.

More specifically, the input unit 210A includes first and second PMOS transistors MP1 and MP2. The first PMOS transistor MP1 includes a source receiving the external supply voltage VCC through the first input terminal IN1, a gate receiving the internal supply voltage VDD through the second input terminal IN2, and a drain connected with the output unit 210B. The second PMOS transistor MP2 includes a source receiving the internal supply voltage VDD through the second input terminal IN2, a gate receiving the external supply voltage VCC through the first input terminal IN1, and a drain connected with the output unit 210B.

In the rising period of the internal supply voltage VDD, if the internal supply voltage VDD is lower than the external supply voltage VCC, the first PMOS transistor MP1 is turned on because the voltage difference between the gate and the source of the first PMOS transistor MP1 is lower than 0. Also, because the voltage difference between the gate and the source of the second PMOS transistor MP2 is higher than 0, the second PMOS transistor MP2 is turned off. Thus, the input unit 210A outputs the external supply voltage VCC through the drain of the first PMOS transistor MP1.

In the rising period of the internal supply voltage VDD, however, if the internal supply voltage VDD exceeds the external supply voltage VCC, the first PMOS transistor MP1 is turned off because the voltage difference between the gate and the source of the first PMOS transistor MP1 is higher than 0. Also, because the voltage difference between the gate and the source of the second PMOS transistor MP2 is lower than 0, the second PMOS transistor MP2 is turned on. Thus, the input unit 210A provides the output unit 210B with the internal supply voltage VDD higher than the external supply voltage VCC through the drain of the second PMOS transistor MP2.

If the internal supply voltage VDD is lower than the external supply voltage VCC, the output unit 210B receives the external supply voltage VCC to output the first logic signal LS1 in the low state. If the internal supply voltage VDD is higher than the external supply voltage VCC, the output unit 210B receives the internal supply voltage VDD higher than the external supply voltage VCC to output the first logic signal LS1 in the high state.

More specifically, the output unit 210B includes first and second NMOS transistors MN1 and MN2. Hereinafter, a node at which the drain of the second PMOS transistor MP2 is connected with the drain of the second NMOS transistor MN2 will be referred to as a first node N1.

The first NMOS transistor MN1 includes a gate connected with the first node N1, a drain connected with the drain of the first PMOS transistor MP1 of the input unit 210A, and a source connected with the ground supply voltage VSS. The second NMOS transistor MN2 includes a gate connected with a node between the first PMOS transistor MP1 of the input unit 210A and the first NMOS transistor MN1, a drain connected with the first node N1, and a source connected with the ground supply voltage VSS.

In the rising period of the internal supply voltage VDD, if the internal supply voltage VDD is lower than the external supply voltage VCC, the gate of the second NMOS transistor MN2 receives the external supply voltage VCC through the drain of the first PMOS transistor MP1. Thus, the second NMOS transistor MN2 is turned on, so that a current path is formed between the first node N1 and the ground supply voltage VSS. Consequently, the ground supply voltage VSS is applied to the first node N1. At this time, the first NMOS transistor MN1 is turned off in response to the potential of the first node N1 to which the ground supply voltage VSS is applied. Thus, while the internal supply voltage VDD is increasing in the period where the internal supply voltage VDD is lower than the external supply voltage VCC, the potential of the first node N1 is maintained at the ground supply voltage VSS. Accordingly, the output unit 210B outputs the potential of the first node N1, which is maintained at the ground supply voltage VSS, through the first output terminal OUT1 as the first logic signal LS1 in the low state.

On the contrary, if the internal supply voltage VDD exceeds the external supply voltage VCC, the first NMOS transistor MN1 is turned on in response to the internal supply voltage VDD, which is higher than the external supply voltage VCC, applied through the drain of the second PMOS transistor MP2. As the first NMOS transistor MN1 is turned on, a current path is formed between the gate of the second NMOS transistor MN2 and the ground supply voltage VSS, so that the ground supply voltage VSS is applied to the gate of the second NMOS transistor MN2. Thus, the second NMOS transistor MN2 is turned off. In such a state where the second NMOS transistor MN2 is being turned off, the internal supply voltage VDD higher than the external supply voltage VCC is applied to the first node N1 through the drain of the second PMOS transistor MP2. Thus, the potential of the first node N1 increases from the ground supply voltage VSS to the internal supply voltage VDD that is higher than the external supply voltage VCC. Then, the potential of the first node N1 is output through the first output terminal OUT1 as the first logic signal LS1 in the high state.

The first boosting unit 220 has a combination structure of a third PMOS transistor MP3 and a first inverter INV1.

More specifically, the third PMOS transistor MP3 has a source receiving the internal supply voltage VDD, a gate connected with an output terminal of the first inverter INV1, and a drain connected with an input terminal of the first inverter INV1.

In the rising period of the internal supply voltage VDD, if the internal supply voltage VDD is lower than the external supply voltage VCC, the first inverter INV1 receives the first logic signal LS1 in the low state and inverts the logic state of the first logic signal LS1 from the low state to the high state. Thus, the third PMOS transistor MP3 is turned off. The first inverter INV1 must be designed to be driven by the external supply voltage VCC. If the first inverter INV1 is driven by the internal supply voltage VDD that is gradually increased, the first inverter INV1 may not clearly invert the logic state of the first logic signal LS1 from the low state to the high state. Thus, the third PMOS transistor MP3 is turned on when the third PMOS transistor MP3 should be turned off, so that the potential of the first node N1 increases. Accordingly, during the period where the internal supply voltage VD increases to a level lower than that of the external supply voltage VCC, the first inverter INV1 is driven by the external supply voltage VCC in order to allow the first node N1 to be in the low state.

Meanwhile, in the rising period of the internal supply voltage VDD, if the internal supply voltage VDD exceeds the external supply voltage VCC, the first inverter INV1 receives the first logic signal LS1 in the high state and inverts the logic state of the first logic signal LS1 from the high state to the low state. Thus, the first logic signal LS1 in the low state is applied to the gate of the third PMOS transistor MP3 to turn on the third PMOS transistor MP3. As the third PMOS transistor MP3 is turned on, a current path is formed between the internal supply voltage VDD provided to the first boosting unit 220 and the first node N1, so that the potential of the first node N1 is boosted to the internal supply voltage VDD, which has been already increased to the level higher than that of the external supply voltage VCC. As a result, at the point in time at which the internal supply voltage VDD reaches the external supply voltage VCC, the first logic signal LS1 at the first node N1 is quickly transited from the low state to the high state by the first boosting unit 220.

The reset controller 240 includes the third and fourth input terminals IN3 and IN4 and the second output terminal OUT2. The reset controller 240 receives the first logic signal LS1 in the high state from the comparator 210 through the third and fourth input terminals IN3 and IN4, and outputs the reset signal RSTB, which resets the driving unit 300, in response to the first logic signal LS1 in the high state.

More specifically, the reset controller 240 includes an inverter unit 240A and a delay unit 240B. The inverter unit 240A includes second and third inverters INV2 and INV3 that each receive the first logic signal LS1 through the third and fourth input terminals IN3 and IN4 respectively to output first inverted logic signals LS1. Thus, if the first logic signal LS1 in the high state is input, the inverter unit 240A outputs two first logic signals in a low state.

The delay unit 240B includes fourth, fifth and sixth PMOS transistors MP4, MP5 and MP6 and a third NMOS transistor MN3, which are serially connected between the internal supply voltage VDD and the ground supply voltage VSS, and a capacitor Cd. Gates of the fourth and fifth PMOS transistors MP4 and MP5 are connected with a source of the sixth PMOS transistor MP6, so that the fourth and fifth PMOS transistors MP4 and MP5 constitute a resistor. A gate of the sixth PMOS transistor MP6 is connected with an output terminal of the second inverter INV2, and a gate of the third NMOS transistor MN3 is connected with an output terminal of the third inverter INV3. The capacitor Cd is connected in parallel with the third NMOS transistor MN3. Hereinafter, a node, at which a drain of the sixth PMOS transistor MP6 is connected with a drain of the third NMOS transistor MN3 will be referred to as a second node N2. The second node N2 is connected with the second output terminal OUT2 of the reset controller 240.

If the first logic signal LS1 in the low state is input to the inverter unit 240A through the third and fourth input terminals IN3 and IN4, the inverter unit 240A outputs two first logic signals in a high state. Thus, the sixth PMOS transistor MP6 is turned off and the third NMOS transistor MN3 is turned on, so that the potential of the second node N2 is reduced to the ground supply voltage VSS.

If the first logic signal LS1 in the high state is input to the inverter unit 240A through the third and fourth input terminals IN3 and IN4, the inverter unit 240A outputs two first logic signals in the low state. Thus, the sixth PMOS transistor MP6 is turned on and the third NMOS transistor MN3 is turned off, so that the potential of the second node N2 increases from the ground supply voltage VSS to the internal supply voltage VDD that is higher than the external supply voltage VCC. At this time, because the sixth PMOS transistor MP6 is turned on, the fourth and fifth PMOS transistors MP4 and MP5 and the capacitor Cd form an RC (resistor and capacitor) circuit. The transition time point of the reset signal RSTB from the low state to the high state is delayed by a predetermined delay time according to a calculated RC time constant of the RC circuit. The delay time is set to the reset time at which the driving unit 300 performs a reset operation.

Figure 4:
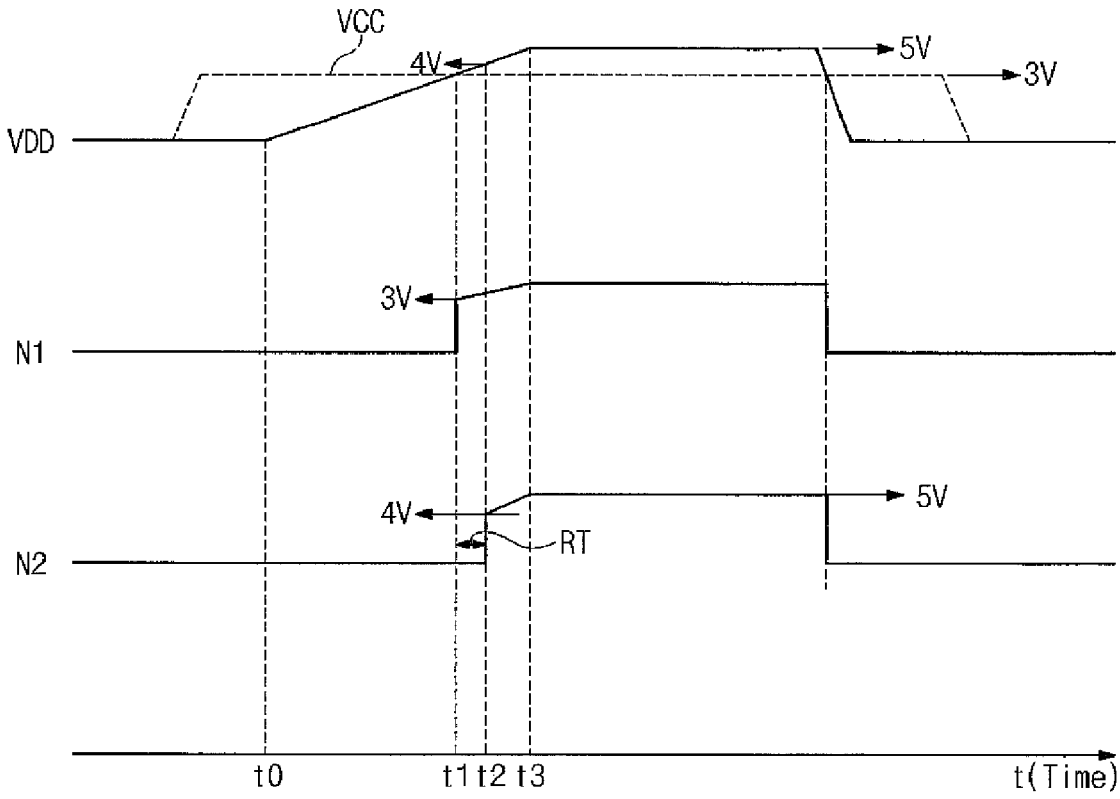
FIG. 4 is a timing diagram illustrating operation characteristics of the driving apparatus shown in FIG. 1.

FIG. 4 is a timing diagram illustrating characteristics of the operation of the driving apparatus shown in FIG. 1. FIG. 4 shows three voltage waveforms marked by solid lines and one voltage waveform marked by dotted lines. FIG. 4 sequentially shows the voltage waveform of the internal supply voltage VDD marked by the solid line and the voltage waveform of the external supply voltage VCC marked by the dotted line, the voltage waveform illustrating the potential of the first node N1 shown in FIG. 3, and the voltage waveform illustrating the potential of the second node N2 shown in FIG. 3. The following description will be given on the assumption that the internal supply voltage VDD necessary for a normal operation of the driving unit 300 (see FIG. 1) is about 5V, and the external supply voltage VCC provided to the voltage generator 100 (see FIG. 1) in order to generate the internal supply voltage VDD of about 5V is about 3V.

Referring to FIG. 4, if the driving apparatus 500 is powered on, the internal supply voltage VDD is increased with a predetermined slope during the rising period ($t0 \leqq t \leqq t3$), maintained at a predetermined voltage level, for example, 5V, after t3, and then reduced to the ground supply voltage VSS.

In the period ($t0 \leqq t \leqq t1$) where the internal supply voltage VDD is lower than the external supply voltage VCC, the first node N1 maintains the ground supply voltage VSS, for example, 0V. More specifically, the first node N1 outputs the ground supply voltage VSS as the first logic signal LS1 in the low state. Thus, in the period ($t0 \leqq t \leqq t1$), a second logic signal LS2 at the second node N2 is in a low state.

Meanwhile, if t is t1, that is, if the internal supply voltage VDD reaches the external supply voltage VCC, the potential of the first node N1 is quickly increased to 3V by the first boosting unit (220 of FIG. 2) as shown in FIG. 4, so that the potential of the second node N2 is also increased. At this time, the potential of the second node N2 is delayed by the delay time based on the RC time constant of the RC circuit including the fourth and fifth PMOS transistors MP4 and MP5 and the capacitor Cd, and then increased. As described above, the delay time is set to a reset period RT and the driving unit 300 is reset during the reset period RT. More specifically, the reset signal generator 200 provides the driving unit 300 with the second logic signal LS2 in the low state corresponding to the reset period RT as the reset signal RSTB.

As a result, the reset signal generator 200 provided in the driving apparatus 500 applies the reset signal RSTB to the driving unit 300 if the internal supply voltage VDD exceeds the external supply voltage VCC. Thus, the driving unit 300 is reset after the internal supply voltage VDD reaches a stable voltage level, so that an abnormal operation of the driving unit 300 during the initial operation can be prevented.

The delay time is determined by adjusting the length of the gates of the fourth and fifth PMOS transistors MP4 and MP5, which constitute the resistor, and the capacitance of the capacitor Cd. In the present exemplary embodiment, the increase in the potential of the second node N2 is delayed from the time point t1 to the time point t2. If the internal supply voltage VDD is about 4V at the time point t2, the second node N2 is quickly increased up to 4V from the ground supply voltage VSS by the second boosting unit (250 of FIG. 2), as shown in FIG. 4. Then, in $t2 < t < t3$, the potential of the second node N2 is increased up to 5V along the slope of the internal supply voltage VDD.

Figure 5:
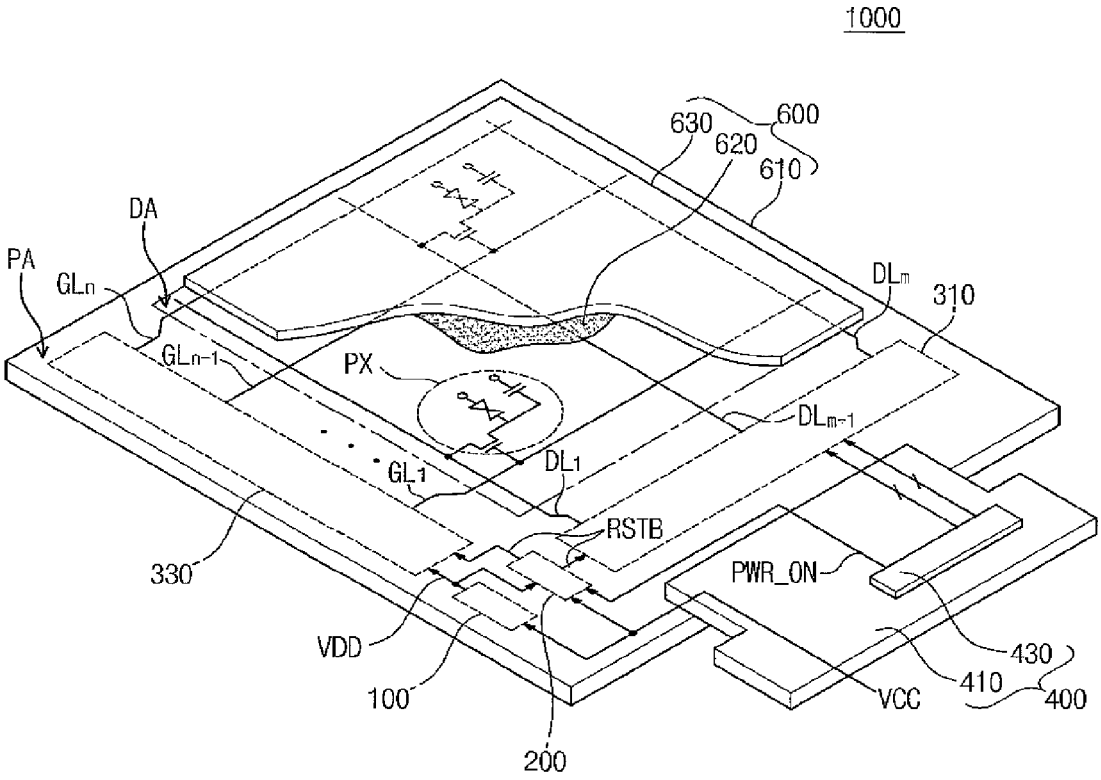
FIG. 5 is a perspective view illustrating an exemplary embodiment of an LCD according to the present invention.

FIG. 5 is a perspective view illustrating an LCD according to an exemplary embodiment of the present invention. In FIG. 5, the same reference numerals are used to designate the same elements as those of FIG. 1.

Referring to FIG. 5, the LCD 1000 includes an LCD panel 600, a driving unit made up of a data driver 310 and a gate driver 330, the reset signal generator 200, the voltage generator 100 and the signal controller 400.

The LCD panel 600 includes an array substrate 610, a color filter substrate 630, and a liquid crystal layer 620 interposed between the array substrate 610 and the color filter substrate 630. The color filter substrate 630 is coupled with the array substrate 610 and faces the array substrate 610. A display area DA shown in dashed-dotted lines to display an image and a peripheral area PA surrounding the display area DA are defined on the LCD panel 600.

The array substrate 610 corresponding to the display area DA includes a plurality of gate lines GL1 to GLn, and a plurality of data lines DL1 to DLm insulated from the gate lines GL1 to GLn, while crossing the gate lines GL1 to GLn. A plurality of pixel areas PX are defined by the gate lines GL1 to GLn and the data lines DL1 to DLm in a matrix in the display area DA. Each pixel area PX includes a thin film transistor and a liquid crystal capacitor connected with the thin film transistor. More specifically, in the first pixel area PX, a gate electrode of the thin film transistor is connected with the first gate line GL1, a source electrode thereof is connected with the first data line DL1, and a drain electrode thereof is connected with the liquid crystal capacitor.

The driving unit includes the data driver 310 and the gate driver 330. According to an exemplary embodiment of the present invention, the data driver 310 and the gate driver 330 are arranged in the peripheral area PA of the LCD panel 600. More specifically, the data driver 310 and the gate driver 330 are substantially simultaneously formed on the array substrate 610 through a thin film process. The data driver 310 is electrically connected with the data lines DL1 to DLm to apply the data driving signal DS to the data lines DL1 to DLm. The gate driver 330 is electrically connected with the gate lines GL1 to GLn to apply the gate driving signal GS to the gate lines GL1 to GLn. The gate driving signal turns on the thin film transistors respectively connected with the gate lines GL1 to GLn. The data driver 310 and the gate driver 330 are reset in response to the reset signal RSTB provided from the reset signal generator 200.

The voltage generator 100 receives the external supply voltage VCC and generates the internal supply voltage VDD higher than the external supply voltage VCC. Because the voltage generator 100 has been described in detail with reference to FIGS. 1 to 4, the detailed description thereof will be omitted. In the present exemplary embodiment, the voltage generator 100 is arranged in the peripheral area PA of the LCD panel 600, so that various transistors constituting the internal circuits of the voltage generator 100 may be formed on the LCD panel 600 through the thin film process. Alternatively, the voltage generator 100 may be provided in the signal controller 400.

The reset signal generator 200 outputs the reset signal RSTB, which resets the data driver 310 and the gate driver 330, if the internal supply voltage VDD exceeds the external supply voltage VCC in the rising period of the internal supply voltage VDD. Because the reset signal generator 200 has been described in detail with reference to FIGS. 1 to 4, the detailed description thereof will be omitted.

The reset signal generator 200, the driving unit 300 and the voltage generator 100 are substantially simultaneously formed on the array substrate 610 through the thin film process. Thus, transistors, for example, MP1 to MP6, MN1 to MN3, and transistors constituting the first to fourth inverters INV1 to INV4, constituting the reset signal generator 200 are prepared in the form of polysilicon transistors. Consequently, a process of forming the reset signal generator 200, the driving unit 310, 330, and the voltage generator 100 on the array substrate 610 may be simplified.

According to the above-described exemplary embodiment, the driving circuits provided in the driving apparatus are reset after the internal supply voltage reaches the sufficient voltage level. Thus, the driving circuits are prevented from being reset before the internal supply voltage reaches the sufficient voltage level, so that abnormal operation of the driving circuits may be prevented.

Although exemplary embodiments of the present invention have been described, it is understood that the present invention should not be limited to these exemplary embodiments but various changes and modifications can be made by one of ordinary skill in the art within the spirit and scope of the present invention, as hereinafter claimed.

What is claimed is:

1. A driving apparatus driving a display panel that displays an image in response to a driving signal, the driving apparatus comprising:

a voltage generator receiving an external supply voltage and producing therefrom an internal supply voltage by boosting the external supply voltage;

a driving unit outputting the driving signal based on the internal supply voltage; and a reset signal generator receiving the external supply voltage and the internal supply voltage and producing a reset signal that resets the driving unit, wherein the reset signal generator includes:

a first transistor having a source receiving the external supply voltage, a gate receiving the internal supply voltage, and a drain;

a second transistor having a source receiving the internal supply voltage, a drain connected with a first node, and a gate receiving the external supply voltage;

a third transistor having a gate connected with the first node, a drain gate connected with the drain of the second transistor, and a source connected with a ground supply voltage;

a fourth transistor having a gate connected with the drain of the first transistor, a drain gate connected with the drain of the second transistor, and a source connected with the ground supply voltage; and a reset controller generating the reset signal in response to a first logic signal; wherein when the internal supply voltage exceeds the external supply voltage in a rising period of the internal supply voltage, the first node outputs the internal supply voltage as the first logic signal.

2. The driving apparatus of claim 1, wherein the reset controller comprises:

an inverter unit inverting the first logic signal; and a delay unit generating a second logic signal in response to the inverted first logic signal and delaying the second logic signal by a predetermined delay time to generate the reset signal.

3. The driving apparatus of claim 2, wherein the delay unit comprises:

first, second, and third PMOS transistors and a first NMOS transistor serially connected between the internal supply voltage and ground supply voltage;

a second node connecting a drain of the third PMOS transistor with a drain of the first NMOS transistor; and a capacitor provided between the second node and the ground supply voltage, wherein gates of the first and second PMOS transistors are connected with the drain of the third PMOS transistor, and gates of the third PMOS transistor and the first NMOS transistor are connected with an output terminal of the inverter unit.

4. The driving apparatus of claim 3, wherein the first and second PMOS transistors and the capacitor constitute an RC circuit when the third PMOS transistor is turned on in response to the inverted first logic signal.

5. The driving apparatus of claim 4, wherein the second node receives the internal supply voltage higher than the external supply voltage according to a turn-on operation of the third PMOS transistor, and outputs the internal supply voltage as the second logic signal.

6. The driving apparatus of claim 5, wherein the RC circuit delays the second logic signal by a predetermined delay time, and generates the reset signal that resets the driving unit during the delay time to output the reset signal through the second node.

7. A liquid crystal display comprising:

a voltage generator receiving an external supply voltage and boosting the external supply voltage to output an internal supply voltage;

a reset signal generator receiving the external supply voltage and the internal supply voltage and producing a reset signal;

a driving unit generating a driving signal in response to the internal supply voltage and resetting the driving signal in response to the reset signal; and a liquid crystal display panel having a display area displaying an image in response to the driving signal, and a peripheral area surrounding the display area, wherein the reset signal generator includes:

a first transistor having a source receiving the external supply voltage, a gate receiving the internal supply voltage, and a drain;

a second transistor having a source receiving the internal supply voltage, a drain connected with a first node, and a gate receiving the external supply voltage;

a third transistor having a gate connected with the first node, a drain gate connected with the drain of the first transistor, and a source connected with a ground supply voltage;

a fourth transistor having a gate connected with the drain of the first transistor, a drain gate connected with the drain of the second transistor, and a source connected with the ground supply voltage; and a reset controller generating the reset signal in response to a first logic signal; wherein when the internal supply voltage exceeds the external supply voltage in a rising period of the internal supply voltage, the first node outputs the internal supply voltage as the first logic signal.

8. The liquid crystal display of claim 7, wherein the reset signal generator is arranged in the peripheral area.

9. The liquid crystal display of claim 8, wherein the voltage generator is arranged in the peripheral area and adjacent the reset signal generator.

10. The liquid crystal display of claim 7, wherein the reset controller comprises:

an inverter unit inverting the first logic signal; and a delay unit generating a second logic signal in response to the inverted first logic signal and delaying the second logic signal by a predetermined delay time to generate the reset signal.

11. The liquid crystal display of claim 7, wherein the first and second transistors and the third and fourth transistors are prepared in a form of polysilicon transistors.

* * * * *